US005246114A

United States Patent [19]

Underwood

[11] Patent Number: 5,246,114

[45] Date of Patent: Sep. 21, 1993

[54] PRESERVING PACKAGE AND METHOD OF STORAGE

[76] Inventor: John P. Underwood, 42 W. Vogel, Phoenix, Ariz. 85021

[21] Appl. No.: 882,302

[22] Filed: May 13, 1992

Related U.S. Application Data

[63] Continuation-in-part of Ser. No. 743,809, Aug. 12, 1991, abandoned.

[51] Int. Cl.[5] ..... B65D 81/20

[52] U.S. Cl. ..... 206/524.8; 206/524; 206/0.6; 383/3; 383/78; 2208/324

[58] Field of Search ..... 383/78, 3, 5, 16, 63; 220/324; 206/0.6, 524.8, 524, 522

[56] References Cited

U.S. PATENT DOCUMENTS

| | | | |
|---|---|---|---|
| 123,113 | 1/1872 | Lamdin | 383/16 |
| 277,613 | 5/1883 | Rockey | 220/324 |
| 2,803,368 | 8/1957 | Koch | 220/324 X |
| 3,464,579 | 9/1969 | Asenbauer | 220/324 X |
| 3,521,806 | 7/1970 | Esty | 383/3 X |
| 4,155,453 | 5/1979 | Oko | 383/3 |
| 4,262,801 | 4/1981 | Avery | 383/3 |
| 5,005,700 | 4/1991 | Rohling et al. | 206/524.8 |
| 5,035,518 | 7/1991 | McClintock | 383/78 |
| 5,080,155 | 1/1992 | Crozier | 383/63 |

FOREIGN PATENT DOCUMENTS

| | | | |
|---|---|---|---|
| 674799 | 11/1963 | Canada | 383/78 |
| 2263953 | 7/1974 | Fed. Rep. of Germany | 206/524 |
| 1459995 | 10/1966 | France | 220/324 |
| 2428587 | 2/1980 | France | 206/524.8 |
| 932966 | 7/1963 | United Kingdom | 383/3 |
| 960475 | 6/1964 | United Kingdom | 383/16 |
| 2137162 | 10/1984 | United Kingdom | 383/5 |
| 2236089 | 3/1991 | United Kingdom | 383/16 |

*Primary Examiner*—William I. Price

*Attorney, Agent, or Firm*—Don J. Flickinger; Jordan M. Neschkow; Robert A. Parsons

[57] ABSTRACT

A method and device for protecting objects in storage from damaging environments including a collapsible bag with a sealable opening having a vacuum attachment, for evacuating the bag, and an injection valve, for injecting an atmosphere, attached.

15 Claims, 3 Drawing Sheets

FIG. 6
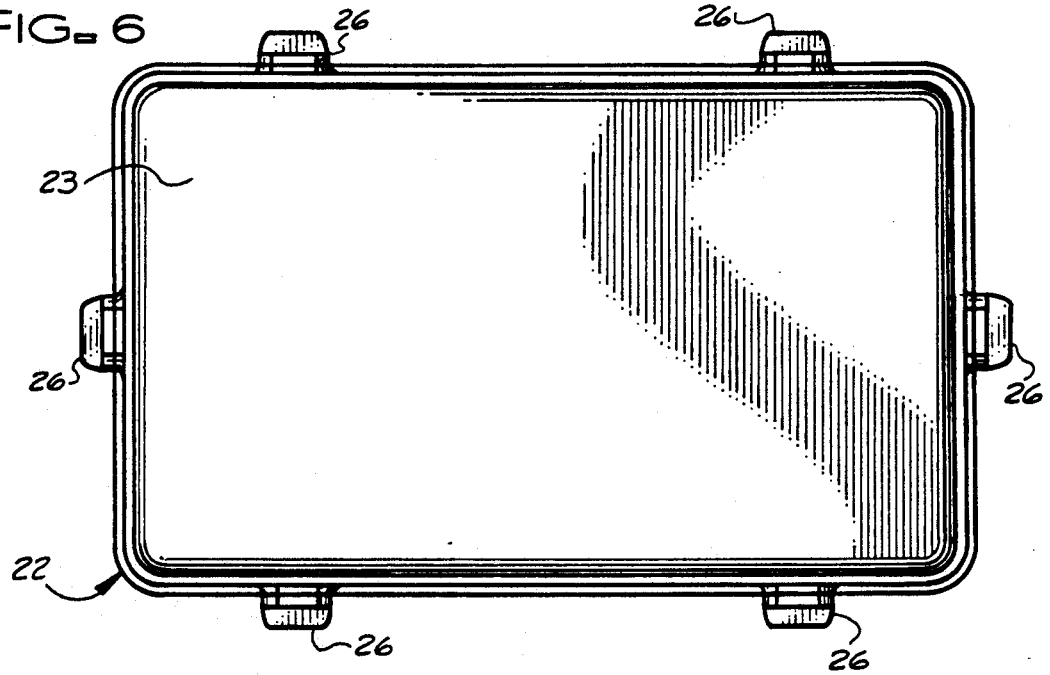
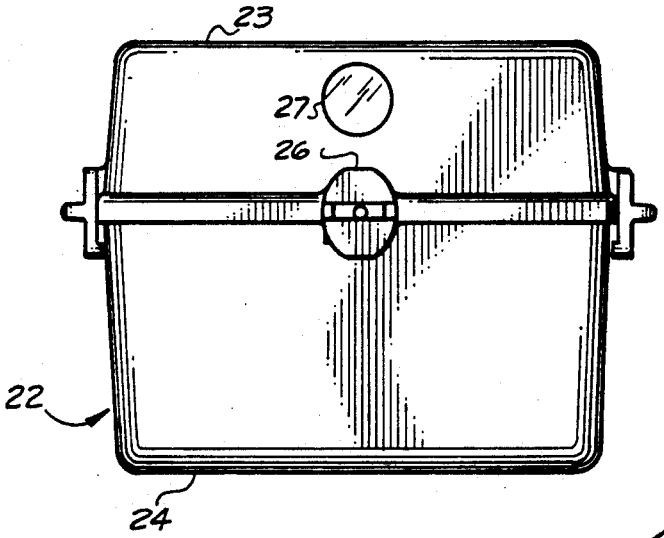
FIG. 7
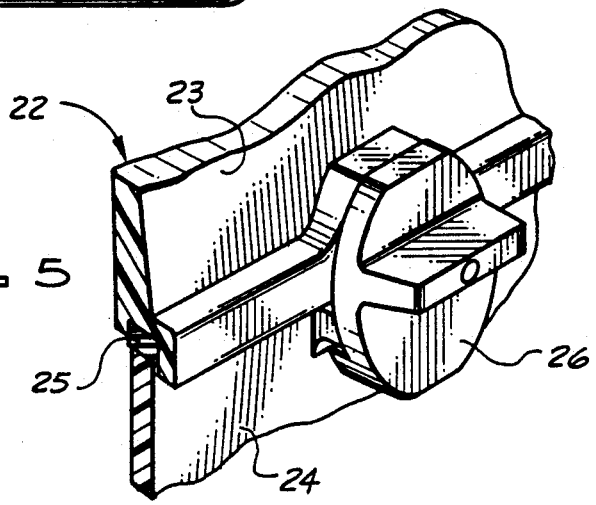
FIG. 5

FIG. 8
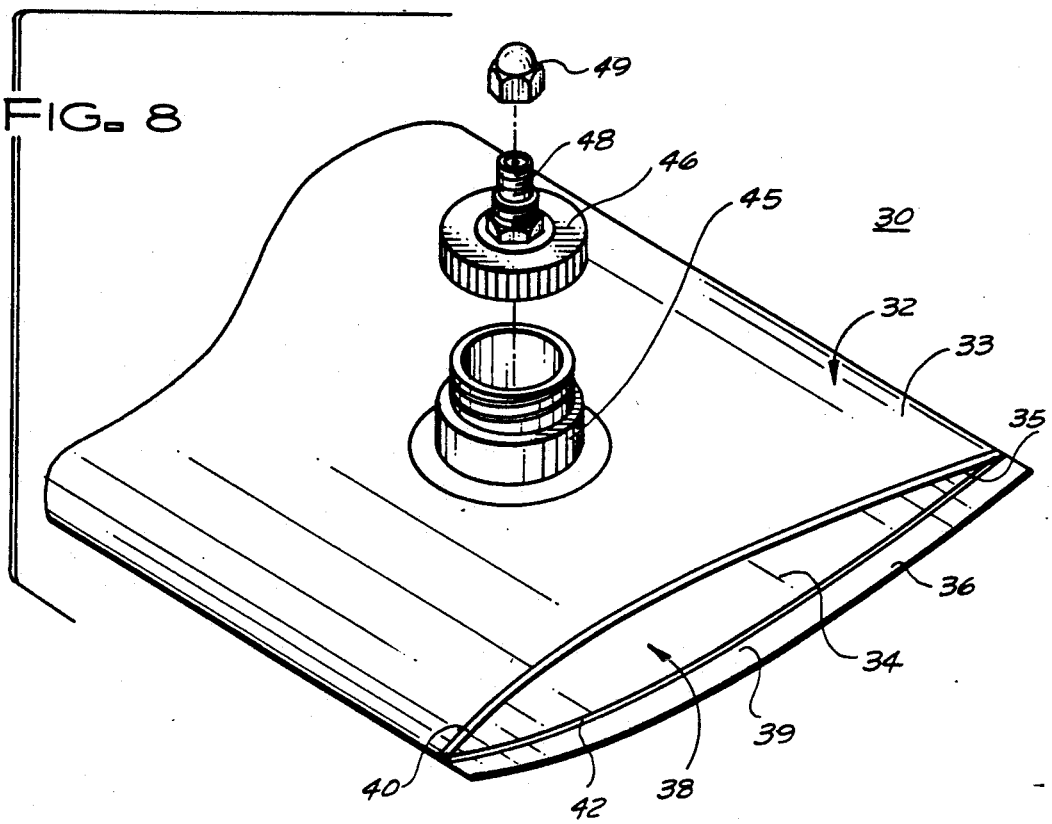
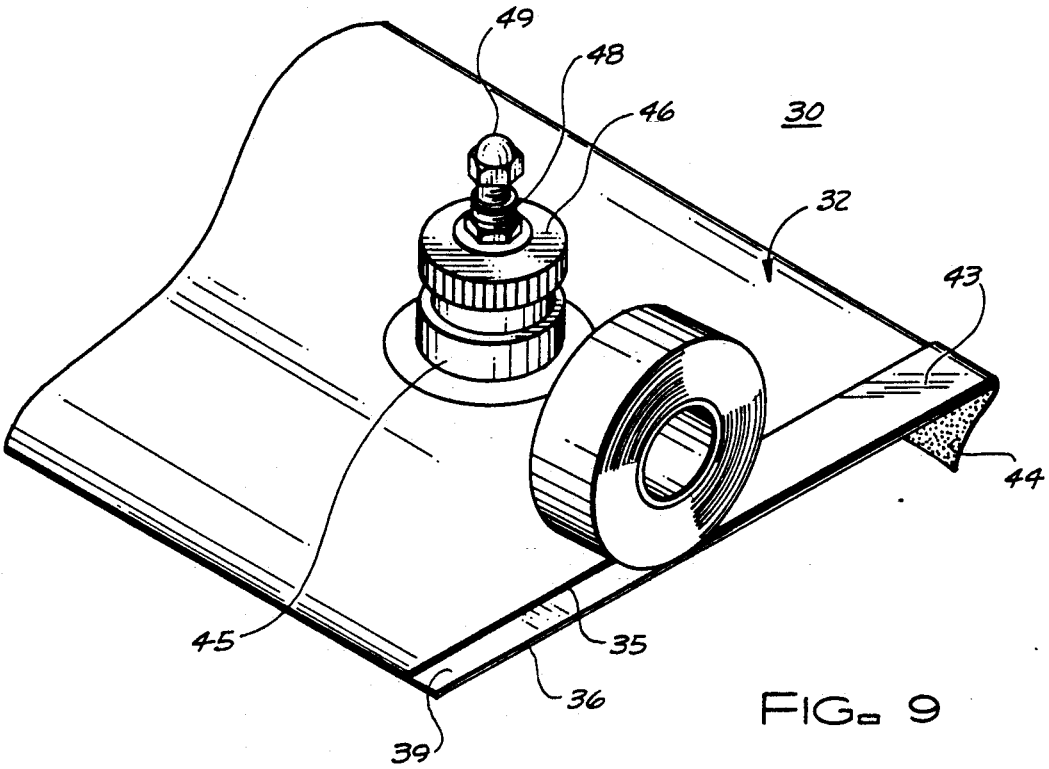
FIG. 9

PRESERVING PACKAGE AND METHOD OF STORAGE

CROSS-REFERENCE TO RELATED APPLICATIONS

This application is a Continuation-In-Part of prior application Ser. No. 07/743,809 filed 12 Aug. 1991 now abandoned.

BACKGROUND OF THE INVENTION

1. Field of the Invention

This invention relates to packages and methods of packaging.

More particularly, the present invention relates to protecting objects from the deleterious effects of different environments.

In a further more specific aspect, the present invention concerns the storage and protection of a preserving package.

2. Prior Art

When storing an object, it is desirable to protect that object in some manner so as to insure its value or usefulness when needed in the future. There are many ways this can be accomplished, depending on the object to be stored and the environment in which it is stored. The need for protection has long been realized, and the prior art teaches many ways to accomplish this goal. However, some objects require more protection than others, and some environments are more destructive than others. Much of the prior art is limited to specific objects and environments.

Protective covers for automobiles, aircraft and other vehicles have long been know, and they adequately fulfill their functions, however, these covers are primarily used to prevent rain, dust and other atmospheric particulates from settling on the vehicle. They therefore cover the vehicle but seldom completely insulate the vehicle from the environment. For more delicate objects, or more corrosive environments, a more complete protection is required.

Sometimes an object is completely enclosed and sealed in a container, or web-coated. Both methods completely isolate the object from the environment, but also has some problems. The webbing method can only be used on relatively strong rigid objects and can cause damage when removed. The sealed container can contain an atmosphere which is destructive to a sensitive object. It would be highly advantageous, therefore, to remedy the foregoing and other deficiencies inherent in the prior art.

Accordingly, it is an object of the present invention to provide a new and improved preserving package.

Another object of the present invention is to provide a preserving package for storing an object.

And another object of the present invention is to provide a package for protecting an object from the environment Still another object of the present invention is to store an object in an inert atmosphere.

A further object is to provide a method for storing an object away from a damaging environment.

Yet another object of the invention is to provide a method for protectively storing objects of substantially any size or shape.

And a further object of the present invention is to provide a container to store and protect a preserving package when it is being shipped.

SUMMARY OF THE INVENTION

Briefly, to achieve the desired objects of the instant invention in accordance with the preferred embodiment thereof, provided is a preserving package having a collapsible bag with a sealable opening. A vacuum valve is coupled to the container so the atmosphere can be evacuated when sealed, and an injection valve is coupled to the collapsible bag so a desired atmosphere can be injected into the collapsible bag when evacuated.

In accordance with a more specific embodiment, the preserving package can be stored in a protective container having a top half and a bottom half. The preserving package is placed in the bottom half and secured in position. The top half is placed on the bottom half and fastened in place.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings in which:

FIG. 5 is an enlarged view of a fastening of protective container;

FIG. 6 is a top view of the protective container;

FIG. 7 is an end view of the protective container;

FIG. 8 is an exploded perspective view of an alternate embodiment of the present invention; and FIG. 9 is a partial perspective view of the preserving package illustrated in FIG. 8 showing an alternate sealing structure.

DETAILED DESCRIPTION OF THE PREFERRED EMBODIMENT

Figure 1:
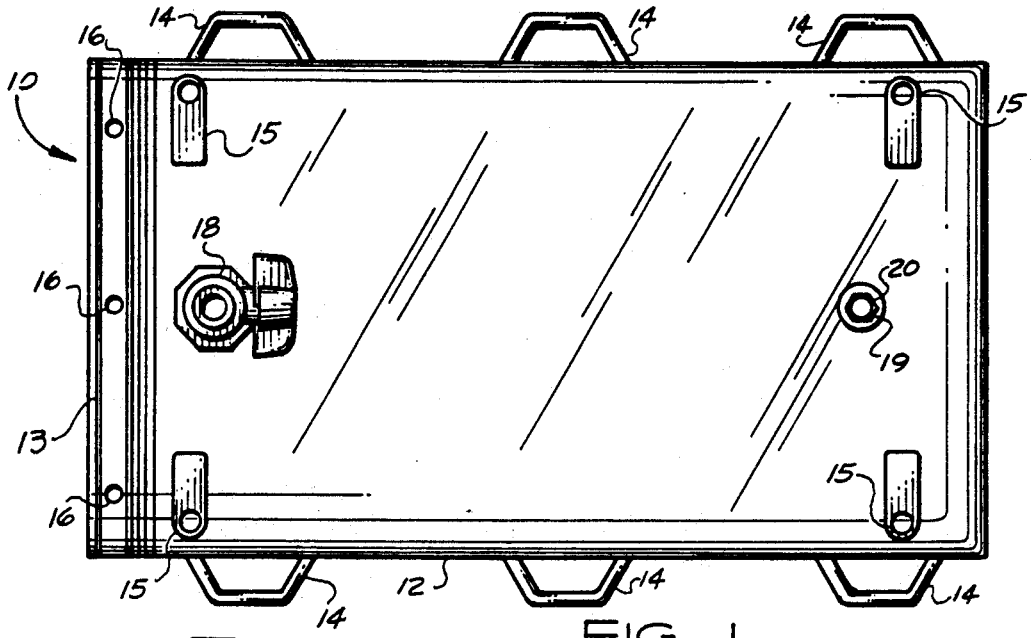
FIG. 1 is a top view of the preserving package.

Turning now to the drawings in which like reference characters indicate corresponding elements throughout the several views, attention is first directed to FIG. 1 which illustrates a preserving package generally designated 10. Preserving package 10 is a collapsible bag 12 with a sealable opening 13 using a zip lock structure. In this embodiment, collapsible bag 12 is generally rectangular in shape, with two sides joined along three edges and sealable opening 13 at the fourth edge. Those skilled in the art will understand that the size of collapsible bag 12 may vary, depending on the size of the object to be stored. Also, while a zip lock structure is used in this embodiment, it will be understood that other known sealing structures could be used. An alternate embodiment disclosing a further sealing structure is discussed below.

Figure 2:
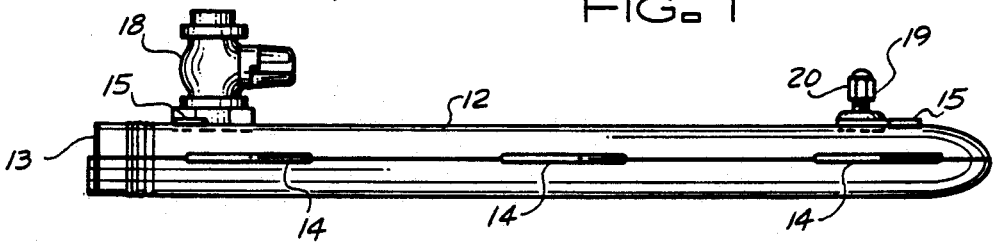
FIG. 2 is a side view of the preserving package.
Figure 3:
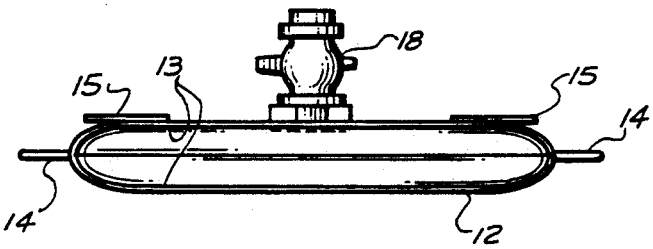
FIG. 3 is an end View of the preserving package.

Still referring to FIG. 1, other structures may be attached to collapsible bag 12, such as handles 14 around its periphery. As can be seen in FIG. 2 and 3, handles 14 are attached to the joined edges of collapsible bag 12. Handles 14 allow the package to be handled and carried with ease. Referring back to FIG. 1, eyelet hangers 15 are attached to the top surface of collapsible bag 12 near each corner. FIG. 3 illustrates how eyelet hangers 15 are tabs which are attached to and extend from the top surface of collapsible bag 12. Eyelet hangers 15 allow preserving package 10 to be stored in a variety of places, including hanging them in storage spaces. Safety lock eyelets 16 are also formed through sealable opening 13, so when sealed, it can be locked giving the package a degree of security.

Referring now to FIG. 2, a vacuum valve 18 is attached near one end of, and extends through the upper surface of collapsible bag 12. Vacuum valve 18 is fitted so a vacuum can be attached, to evacuate the atmosphere from inside sealed collapsible bag 12. Any valve which will facilitate the evacuation of atmosphere from collapsible bag 12, can be used. However, in this embodiment a standard ball valve is used.

Still referring to FIG. 2, an injection valve 19 is attached to and extends through the top surface of collapsible bag 12 similar to vacuum valve 18. This permits any desired atmosphere, such as an inert gas or insecticide to be injected into the vacuum created in collapsible bag 12. In this embodiment, a schrader valve is used, and when the desired atmosphere is injected into collapsible bag 12, a locking cap 20 is coupled to injection valve 19.

Figure 4:
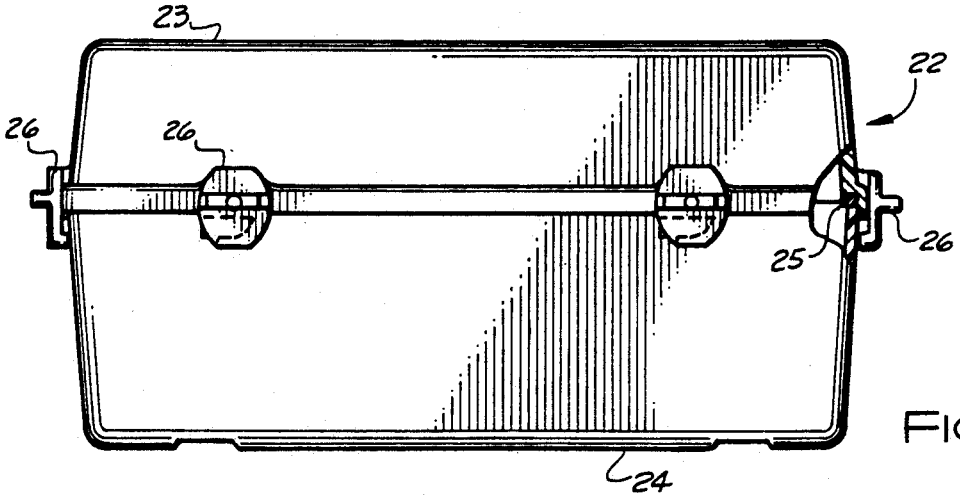
FIG. 4 is a side view of the protective container.

Referring now to FIG. 4, 6 and 7, a protective container generally designated 22 is illustrated. Protective container 22 may be used to store sealed preserving package 10 for long term storage or for added protection when shipping and has a top half 23 which sealably attaches to a bottom half 24. A seal 25, which in this embodiment is similar to a gasket, is inset around the lower edge of top half 23. When top half 23 is placed on bottom half 24, the edges of bottom half 24 press against seal 25. Referring to FIG. 5, top half 23 is fastened to bottom half 24 by twist latches 26, six of which are spaced around the periphery of bottom half 24. When secured, twist latches 26 pull top half 23 tightly against bottom half 24, compressing seal 25 between, and sealably attaching top half 23 to bottom half 24. Window 27, preferably a transparent insert of glass or plastic and sealed in accordance with conventional practice, provides for viewing the contents of container 22.

The steps involved in preserving an object using preserving bag 10 and protective container 22 include placing the object to be protected into collapsible bag 12. As mentioned above, the object may be substantially any size with larger bags provided for larger objects If desired, a preserving or lubricating agent can be added, such as silica gel for machine parts. A bead of silica gel or comparable material is then placed along the zip lock seal and the seal closed by pressing. Once the object is sealed in collapsible bag 12, a vacuum is attached to vacuum valve 18 and the atmosphere is evacuated from the bag. Vacuum valve 18 is then closed. Depending on the object stored, a different atmosphere may be injected into the vacuum in collapsible bag 12 through injection valve 19. Any of a variety of atmospheres may be injected, an inert gas, a preserving agent such as formaldehyde, or an insecticide. Once the atmosphere is injected, locking cap 20 is placed on injection valve 19.

Preserving package 10 with the object sealed inside, can then be stored as is, or packed for long term storage or shipping in protective container 22. First, a piece of acetate is placed in the bottom of bottom half 24. Heated foam is injected onto the top of the acetate and another piece of acetate is placed on top of the foam. Preserving package 10, containing an object, is then placed on the acetate with the foam underneath conforming to its shape. A piece of acetate is placed over preserving package 10 and more heated foam is injected on top of this. A final sheet of acetate is placed over the foam, and top half 23 of protective container 22 is placed on bottom half 23. Care must be taken to insure that seal 25 is in the proper position Twist latches 26 are then secured, sealing preserving package 10 in protective container 22.

An alternate embodiment of a preserving package, generally designated 30, is illustrated in FIG. 8. Preserving package 30 is a collapsible bag 32 having a first sheet 33 and a second sheet 34. Sheets 33 and 34 may be configured with a variety of different dimensions so that a collapsible bag 32 may be formed having a volume sufficient to accommodate different size items. Also, in the preferred embodiments, sheets 33 and 34 are a plastic material such as hexene or polypropylene. First sheet 33 and second sheet 34 are joined at their peripheries by any conventional method including heat sealing and bonding, leaving an edge 35 of first sheet 33 unsealed from an edge 36 of second sheet 34. Unsealed edges 35 and 36 form a sealable opening 38 in collapsible bag 32. Second sheet 34 has a lip 39 extending past edge 35 of first sheet 33 at sealable opening 38. In this embodiment lip 39 extends approximately one inch past edge 35 of first sheet 34, however, this dimension may vary. A line 40 is produced on first sheet 33 proximate to and extending along edge 35. An analoqous line 42 is produced on second sheet 34 proximate to and extending along edge 36 with lip 39 extending therepast Lines 40 and 42 facilitate the aligning of edges 35 and 36 so that lip 39 extends an adequate distance past edge 35 of first sheet 33. Lip 39 must extend past edge 35 so that a sufficient seal can be produced when sealable opening 38 is closed.

Referring now to FIG. 9, sealable opening 38 is sealed by aligning lines 40 and 42, then applying a strip of adhesive tape 43 to edges 35 and lip 39. Adhesive tape 43 is preferably two inches wide, so that when it is applied along sealable opening 38 one edge overlaps and bonds to edge 35, and the other side overlaps and bonds to lip 39. When applying tape 43, an excess portion or flap 44 extends longitudinally past edge 35 and lip 39. Flap 44 is then curled around the side of preserving package 10 and affixed to the underside of second sheet 34 and lip 39. This completely seals sealable opening 38, preventing leakage at the sides where first sheet 33 and second sheet 34 are joined This sealing structure is preferred over the zip lock structure used in preserving package 10, when large items requiring a large collapsible bag are stored. It will be understood by those skilled in the art that many different types of adhesive tapes are available which are sufficiently strong to withstand the minimal pressures exerted by the vacuum and the injection of the preserving material.

Referring back to FIG. 8, a vacuum attachment 45 is affixed to and extends through first sheet 33 of collapsible bag 32. Vacuum attachment 45 is configured for receiving a vacuum with which the atmosphere inside sealed collapsible bag 32 is evacuated. A screw cap 46 couples to and closes vacuum attachment 45.

Still referring to FIG. 8, an injection valve 48 is attached to and extends through the top surface of cover 46. This permits any desired atmosphere, if one is desired instead of a vacuum, to be injected into the vacuum created in collapsible bag 32. In this embodiment, a schrader valve is used, and when the desired atmosphere has been injected into collapsible bag 32, a cap 49 is coupled to injection valve 48.

To preserve an item in preserving package 30, the item is inserted through sealable opening 38, edges 35 and 36 of first sheet 33 and second sheet 34 respectively are aligned by aligning lines 40 and 42. A strip of tape 43 is affixed to edge 35 and lip 39, and flaps 44 are folded back over the sides of collapsible bag 32 completely sealing sealable opening 38. Cover 46 is then removed from vacuum attachment 45, a vacuum is attached, and the atmosphere in preserving package 30 is removed. The vacuum is then removed and the cover quickly coupled to vacuum attachment 45. An inert gas or other preserving material may then be injected into preserving package 30 through injection valve 48, or the item could be left in a vacuum. The removal of the vacuum from vacuum attachment 45 and the sealing of vacuum attachment 45 with cover 46 allows some atmosphere to enter into preserving package 30. However, the amount of ambient atmosphere to enter the preserving package 30 is negligible.

It will be understood by those skilled in the art that handle 14, and eyelet hangers 15 used on preserving package 10 may also be used in combination with preserving package 30. Furthermore, preserving package 30 with an object sealed inside may be stored in a protective container 22, as discussed above for storing preserving package 10.

Various changes and modifications to the embodiment herein chosen for purposes of illustration will readily occur to those skilled in the art. To the extent that such modifications and variation do not depart from the spirit of the invention, they are intended to be included within the scope thereof which is assessed only by a fair interpretation of the following claims.

Having fully described the invention in such and clear and concise terms as to enable those skilled in the art to understand and practice the same, the invention claimed is:

1. A preserving package for storing objects and for containing a preserving atmosphere comprising:
- a collapsible bag having a sealable opening;
- a vacuum attachment affixed to and extending through
- a surface of said collapsible bag; and
- an injection valve attached to and extending through one surface of said collapsible bag.

2. A preserving package as claimed in claim 1 wherein said sealable opening is sealed by zip lock seal.

3. A preserving package as claimed in claim 1 wherein said sealable opening is sealed by adhesive tape.

4. A preserving package as claimed in claim 3 wherein said sealable opening further comprises a first edge and a second edge, said second edge extending past said first edge.

5. A preserving package as claimed in claim 4 further comprising:
- a first line proximate to and extending along said first edge; and
- a second line extending along said second edge at a location analogous to said first line on said first edge.

6. A preserving package as claimed in claim wherein said vacuum attachment is a vacuum valve.

7. A preserving package as claimed in claim 1 wherein said vacuum attachment further comprises an attachment member and a cover, receivable on said attachment member.

8. A preserving package as claimed in claim 7 wherein said injection valve is coupled to and extends through said cover.

9. A preserving package comprising:
- a collapsible bag having a sealable opening;
- a vacuum attachment affixed to and extending through one surface of said collapsible bag;
- an injection valve attached to and extending through one surface of said collapsible bag; and
- a protective container holding said collapsible bag having;
  - a bottom half,
  - a top half,
  - a plurality of twist latches attached to one of said bottom half and said top half,
  - said top half and said bottom half coupled together by said twist latches, and
- a seal attached to said top half and engages with said bottom half when said twist latched are secured.

10. A preserving package as claimed in claim 9 wherein said sealable opening is sealed by a zip lock seal.

11. A preserving package as claimed in claim 9 wherein said sealable opening is sealed by adhesive tape.

12. A preserving as claimed in claim 9 wherein said sealable opening further comprises a first edge and a second edge, said second edge extending past said first edge.

13. A preserving package as claimed in claim 12 further comprising:
- a first line proximate to and extending along said first edge; and
- a second line extending along said second edge at a location analogous to said first line on said first edge.

14. A preserving package as claimed in claim 9 wherein said vacuum attachment is a vacuum valve.

15. A preserving package as claimed in claim 9 wherein said vacuum attachment further comprises an attachment member and a cover receivable on said attachment member.

* * * * *

UNITED STATES PATENT AND TRADEMARK OFFICE

CERTIFICATE OF CORRECTION

PATENT NO. : 5,246,114

DATED : 21 September 1993

INVENTOR(S) : John P. Underwood

It is certified that error appears in the above-indentified patent and that said Letters Patent is hereby corrected as shown below:

On the title page, under "Attorney, Agent, or Firm, change "Neschkow" to --Meschkow--.

In claim 9, column 6, line 32, delete "latched" and insert --latches--.

In claim 12, column 6, line 39, insert --package-- after "preserving".

Signed and Sealed this

Twelfth Day of July, 1994

Bruce Lehman

*Attest:*

BRUCE LEHMAN

*Attesting Officer*

*Commissioner of Patents and Trademarks*